US007862015B2

(12) United States Patent
Kotani

(10) Patent No.: US 7,862,015 B2
(45) Date of Patent: Jan. 4, 2011

(54) SHEET FOLDING DEVICE, AND PAPER POST-PROCESSING DEVICE AND IMAGE FORMING SYSTEM PROVIDED THEREWITH

(75) Inventor: Takashi Kotani, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 319 days.

(21) Appl. No.: 11/976,589

(22) Filed: Oct. 25, 2007

(65) Prior Publication Data

US 2008/0099973 A1 May 1, 2008

(30) Foreign Application Priority Data

Oct. 27, 2006 (JP) ..... 2006-292064

(51) Int. Cl.
*B31F 1/08* (2006.01)
*B41L 43/00* (2006.01)

(52) U.S. Cl. ..... 270/32; 270/20.1; 270/45; 270/58.07

(58) Field of Classification Search ..... 270/20.1, 270/32, 37, 45, 51, 58.07, 58.08, 58.09, 58.11, 270/58.12, 58.17, 58.27
See application file for complete search history.

(56) References Cited

U.S. PATENT DOCUMENTS 5,382,011 A * 1/1995 Tani ..... 270/37
5,711,520 A * 1/1998 Hutson ..... 271/222
6,022,011 A * 2/2000 Hirose ..... 270/37
6,065,748 A * 5/2000 Hutson ..... 271/222
6,217,016 B1 * 4/2001 Honmochi et al. ..... 270/37
7,264,236 B2 * 9/2007 Obuchi et al. ..... 270/37
7,635,121 B2 * 12/2009 Dobashi et al. ..... 270/45
2006/0076724 A1 * 4/2006 Obuchi et al. ..... 270/32
2006/0145408 A1 * 7/2006 Kotani ..... 270/58.08
2008/0265484 A1 * 10/2008 Fukasawa et al. ..... 270/58.12

FOREIGN PATENT DOCUMENTS

JP 2002-167120 6/2002

* cited by examiner

*Primary Examiner*—Leslie A Nicholson, III
(74) *Attorney, Agent, or Firm*—Smith, Gambrell & Russell, LLP

(57) ABSTRACT

In a sheet folding device 1 provided with a folding part 70 for folding a sheet S carried into the device, a discharge part 80 for discharging a sheet S already subjected to folding processing, and a discharge tray 74 for receiving a sheet S discharged from the discharge part 80, a holding member 5 for holding a discharged sheet S from above and an arm 4 disposed above the discharge tray 74 and also adjacently to the discharge part 80 and so provided as to project in a sheet discharge direction are provided. The holding member 5 is supported at the arm 4 in such a manner as to be rotatable upward and downward, and also rotatable to a position above the bottom end of the arm 4.

21 Claims, 10 Drawing Sheets

SHEET FOLDING DEVICE, AND PAPER POST-PROCESSING DEVICE AND IMAGE FORMING SYSTEM PROVIDED THEREWITH

This application is based on Japanese Patent Application No. 2006-292064 filed on Oct. 27, 2006, the contents of which are hereby incorporated by reference.

BACKGROUND OF THE INVENTION

1. Field of the Invention

The present invention relates to a sheet folding device performing folding processing on a sheet where an image is formed by an image forming apparatus, such as a copier, a printer, a facsimile, or the like, and a paper post-processing device provided therewith.

2. Description of Related Art

Conventionally, a sheet folding device has been used which carries therein a sheet where an image is formed by an image forming apparatus and then performs processing of folding the sheet (a bundle of sheets), such as middle folding processing or the like. For example, the sheet folding device is built in a paper post-processing device which is provided adjacently to the image forming apparatus and which performs processing, such as punching processing for forming a punched hole at a predetermined position on a sheet and stapling processing on a plurality of sheets stacked.

More specifically, the sheet folding device includes: a receiving member for receiving a sheet carried in; a width adjusting member for correcting skew of a sheet carried in and adjusting the sheet in the width direction (direction perpendicular to the carry-in direction); a folding part for folding a sheet; a discharge part for discharging a bent sheet from the sheet folding device; a discharge and conveyance path for conveying a sheet from the folding part to the discharge part; a discharge tray for receiving a sheet discharged; and so on. The sheet folding device employs this configuration, and is adapted to perform folding processing on each sheet or a bundle of sheets already subjected to stapling processing or the like.

Further, the sheet folding device is provided with an arm and a holding member in some cases. For example, the arm and the holding member are so provided as to project along the sheet discharge direction from the discharge part of the sheet folding device toward the discharge tray. Moreover, the holding member is typically supported in such a manner as to be rotatable upward and downward below the arm.

Here, the holding member is provided for the purpose of preventing a small-sized sheet or a small number of bent sheets from flying out of the discharge tray by being powerfully discharged. Moreover, since the sheet discharged on the discharge tray swells at its folding portion due to a sheet restoring force, the holding member has a function of pressing this swelling from above to increase the amount of sheets stacked onto the discharge tray.

On the other hand, the arm supports the holding member so that the holding member is rotatable upward and downward, and also serves a decorative function of covering the holding member.

As one example of such a device, the invention described in JP-A-2002-167120 (hereinafter referred to as Patent Document 1) is suggested. Patent document 1 describes a sheet folding device including a paper folding member, a receiving member for receiving the leading end of paper, a receiving member moving member for moving the receiving member, a pair of width shifting members, and a width adjusting member moving member for performing width adjustment on paper in the width direction and skew correction, in which the pair of width adjusting members are arranged upstream of the paper folding member on a paper carry-in path. In the invention described in Patent Document 1, a support point is provided near the sheet discharge part, and this support point permits the arm to be pivotable upward and downward and permits the holding member to be supported at the bottom surface of this arm in a manner such as to be rotatable upward and downward.

Here, referring to FIGS. 9A and 9B, a problem involved in stacking a sheet S after folding processing performed in a conventional sheet folding device 100 will be described. FIG. 9A is a sectional view illustrating a sheet S discharge direction on a discharge tray 101 in the conventional sheet folding device 100. FIG. 9B is a sectional view illustrating stack condition of sheets S on the discharge tray 101 of the conventional sheet folding device 100. The sheet folding device 100 in the description of a conventional example mainly functions to fold a bundle of sheets S. Therefore, the sheet S in FIG. 9A is normally stacked in a plural number, thereby forming a bundle of sheets S, although it is simply illustrated for avoiding complicated figure description. Other portions of the conventional sheet folding device 100 are omitted here.

As shown in FIG. 9A, the conventional sheet folding device 100 typically folds a sheet S (hereinafter, the sheet S includes a bundle of sheets S in the description of the conventional example) by a pair of folding rollers 102 forming a folding part, and then discharges it through a pair of discharge rollers 103 as a discharge part to the discharge tray 101 provided adjacently to the discharge part. Then, the conventional sheet folding device 100 is provided with an arm 104 located above the discharge tray 101 and so provided as to project in the sheet S discharge direction. This arm 104 has a support point P4 near the pair of discharge rollers 103 and is pivotable downward through some degrees. Further, below the support point P4, a support point P5 is provided, which permits a holding member 105 to be provided in such a manner as to be rotatable upward and downward.

A bent sheet S is discharged onto the discharge tray 101 with the folding portion of the sheet S oriented ahead (see FIG. 9B). Then, as shown in FIG. 9A, the discharged sheet S hits the holding member 105, and is thereby guided downward. This prevents a small-sized sheet S or a small number of bent sheets S from flying out of the discharge tray 101 and also prevents the staking on the discharge tray 101 from being disturbed. An arrow of a dashed line shows one example of the direction in which the sheet S is discharged.

Since the holding member 105 is rotatably supported, an increase in the amount of sheets S stacked onto the discharge tray 101 brings the holding member 105 up to the position indicated by a broken line of FIG. 9A (the direction of the holding member 105 is indicated by an arrow of a chain double-dashed line).

Here, stacking of a large number of bundles of sheets S onto the discharge tray 101 typically causes the folding portions of the sheets S to swell due to their restoring forces; therefore, the sheets S are laid one on another in a substantially fan-like form with the folding portions oriented outward (see FIGS. 6A and 6B). Further, the holding member 105 exerts an influence that orients the sheet S discharge direction downward, so that a sheet S newly discharged downwardly hits a sheet S previously discharged, pushing out a bundle of sheets S in the sheet S discharge direction. This consequently causes, as shown in FIG. 9B, the sheet S discharged at the most downstream portion in the sheet S discharge direction to extend over the discharge tray 101 and also causes disturbance of the stack condition of the sheets S.

As described above, the presence of the holding member 105 causes a sheet S newly discharged to hit and push out a sheet S previously discharged and at the same time be so laid as to climb a slope formed by the sheet S previously discharged. Further, as shown in FIG. 9A, the arm 104 and the holding member 105 do not move upward beyond given points, and thus continuously exert the influence that orients a discharged sheet S downward regardless of the amount of sheets S stacked. A large force for pushing out a sheet S may form, as shown in FIG. 9B, such a slope that a sheet S newly discharged can never climb. Then a sheet S discharged from the discharge part can no longer climb the slope and the sheet S covers the discharge part, resulting in a state that the sheet S can no longer be stacked onto the discharge tray 101.

As described above, when a large number of sheets are stacked onto the discharge tray, there arises a problem that the holding member provided for the purpose of increasing the stack volume on the discharge tray by controlling the swelling of discharged sheets undesirably becomes a factor that reduces the stack volume.

Thus, considering the invention described in Patent Document 1, the invention described in Patent Document 1 is intended to perform paper width adjustment and skew correction without taking a relationship between the holding member and the sheet stacking into consideration. Furthermore, Patent Document 1 provides almost no statement about the arm and the holding member, thus failing to cope with the problem described above.

SUMMARY OF THE INVENTION

In view of the problem described above, it is an object of the present invention to provide a sheet folding device capable of increasing the stack volume of sheets discharged therefrom while providing a required holding member therein without upsizing a discharge tray, and also to a post-processing device provided with this sheet folding device.

To address the object described above, one aspect of the invention refers to a sheet folding device including: a folding part for folding a sheet carried into the device; a discharge part for discharging a sheet subjected to folding processing by the folding part; a discharge tray for receiving a sheet discharged from the discharge part; an arm disposed adjacently to the discharge part and projected above the discharge tray in a sheet discharge direction; and a holding member rotatably supported at the arm, holding a sheet discharged onto the discharge tray from above, and also being rotatable to a position above a bottom end of the arm.

With this configuration, since the holding member is rotatable to a position above the bottom end of the arm, an influence that the holding member orients the sheet discharge direction downward is no longer exerted during the course of stacking a large number of sheets. Therefore, a phenomenon that a sheet previously discharged pushes out a sheet being discharged is suppressed, thus resulting in a gentler slope formed by sheets S stacked than is conventionally formed. That is, this permits a larger volume of stacking on the discharge tray without upsizing the discharge tray.

In the sheet folding device with the configuration described above, the holding member may be rotatable to a position above a top end of the arm.

With this configuration, since the holding member is rotatable to the position over the top end of the arm, for example, even configuration such that the holding member projects to the downstream side of the leading end of the arm when the holding member rotates to a position substantially parallel to the arm does not impede stacking, thus permitting an increase in the stack volume of sheets.

In the sheet folding device with the configuration described above, a length of the arm in the sheet discharge direction may be equal to or less than half a maximum length, in a sheet conveyance direction, of a sheet discharged onto the discharge tray after being subjected to the folding processing.

With this configuration, since the length of the arm is shorter than half the length of a bent sheet in the conveyance direction, the stack volume of sheets can be increased. That is, the arm, when a large number of sheets are stacked, used to make contact with the sheet, thereby impeding discharge of the sheets. However, the arm does not impede stacking and discharge of the sheets, thus permitting an increase in the stack volume of sheets.

In the sheet folding device with the configuration described above, the holding member, when oriented horizontally, projects more toward a downstream side in the sheet discharge direction than the arm.

With this configuration, providing a longer length of the holding member than that of the arm permits minimizing the length of the arm while maintaining the effect of holding a sheet by the holding member, compared to a case where the arm is formed longer than the holding member.

In the sheet folding device with configuration described above, the of the holding member may be limited so that, under condition that the holding member rotates to a maximum above the arm, a leading end part of the holding member is located downstream, in the sheet discharge direction, of a vertical line passing through a downstream end of the arm in the sheet discharge direction.

With this configuration, limiting the upward of the holding member permits forming a gentle slope formed by sheets S discharged, thus resulting in a larger amount of sheets stacked on the discharge tray.

In the sheet folding device with the configuration descried above, the holding member may have a thin plate-like leading end part.

With this configuration, a risk of damaging the sheet top surface by the leading end part of the holding member is eliminated.

In the sheet folding device with the configuration described above, the arm may be fixed to the sheet folding device.

With this configuration, the arm is fixed, thereby permitting the arm not to move as a result of discharge of a sheet. Consequently, the arm reliably guides the sheet, whereby the sheet is reliably stacked. Moreover, the upward movement of the arm causes a sheet S being discharged to swell due to its restoring force, thus making it difficult for the discharged sheet to climb the slope. However, the invention can suppress this swelling, thus making it difficult for sheets to close the discharge part, which permits an increase in the stack volume of sheets.

In the sheet folding device with the configuration described above, the arm may be supported at the sheet folding device in a manner such as to be pivotable only upward, and may also be biased downward by a biasing member.

With this configuration, the arm is biased downward, thus permitting the arm not to move as a result of discharge of a sheet. Consequently, the arm reliably guides the sheet, whereby the sheet is reliably stacked. Moreover, suppressing swelling of the sheet being discharged makes it difficult for the sheet to close the discharge part, thereby increasing the stack volume of sheets. Further, the arm can be moved to some extent when the user removes a sheet from the discharge tray or handles paper jam, thus improving the operability.

In the sheet folding device with the configuration described above, a biasing force of the biasing member may be set at at least magnitude with which the arm does not pivot upward as a result of discharge of a sheet from the discharge part.

With this configuration, while adapting the arm to be pivotable upon removal of a sheet from the discharge tray or handling of jam, a decrease in the stack volume due to swelling of a sheet being discharged as a result of upward pivoting of the arm during the discharge of the sheet can be prevented.

In the sheet folding device with the configuration described above, a pivoting member constituting the discharge part and also pivotable with respect to the sheet folding device may be provided, and the arm may be fixed to the pivoting member.

With this configuration, since the arm is integrated with the pivoting member and then pivotably supported at the sheet folding device, the arm does not move easily during discharge of a sheet, thus permitting preventing swelling of the sheet being discharged.

In the sheet folding device with the configuration described above, a pivoting member constituting the discharge part and also pivotable with respect to the sheet folding device may be provided, and the arm may be pivotably supported at the pivoting member.

With this configuration, since the arm is supported at the sheet folding device via the pivoting member, the arm is pivoted in two steps with respect to the sheet folding device. Therefore, the movable range of the arm widens, thus resulting in an improvement in the operability in sheet removal and jam handling.

In the sheet folding device with the configuration described above, upward pivoting of the arm may be limited by the pivoting member.

With this configuration, the upward pivoting of the arm can be more reliably suppressed by the weight of the pivoting member and the biasing force of the biasing member.

In the sheet folding device with the configuration described above, a curved part may be formed at a bottom of a leading end of the arm.

With this configuration, friction between the leading end of the arm and the sheet top surface is reduced, and also a gentle slope of sheets stacked after guided by the arm is formed, thus making it easy for a sheet being discharged to climb the slope, which permits an improvement in the stacking performance.

Another aspect of the invention refers to a paper post-processing device including the sheet folding device with the configuration described above, and introducing a sheet on which an image is formed by an image forming apparatus into the device and performing predetermined processing.

With this configuration, a post-processing device with advantageous cost performance and simple configuration can be provided which increases the stack volume of sheets while fulfilling original functions possessed by the arm and the holding member without upsizing the discharge tray and adding special configuration.

Still another aspect of the invention refers to an image forming system including: the paper post-processing device with the configuration described above; and an image forming apparatus for carrying into the paper post-processing device a sheet on which an image is formed.

With this configuration, an image forming system with excellent usability can be provided which consistently performs a series of processing from image formation to meddle folding processing.

DETAILED DESCRIPTION OF THE PREFERRED EMBODIMENTS

Hereinafter, the embodiment of the present invention will be described, referring to FIGS. 1 to 8. A sheet folding device 1 mentioned in this embodiment will be described, referring to the type that is built at the bottom of a paper post-processing device 3 externally fitted to an image forming apparatus 2. Note that, however, components included in the configuration, arrangement, and the like described in this embodiment do not limit the scope of claims, and just serves as illustrative examples.

Figure 1:
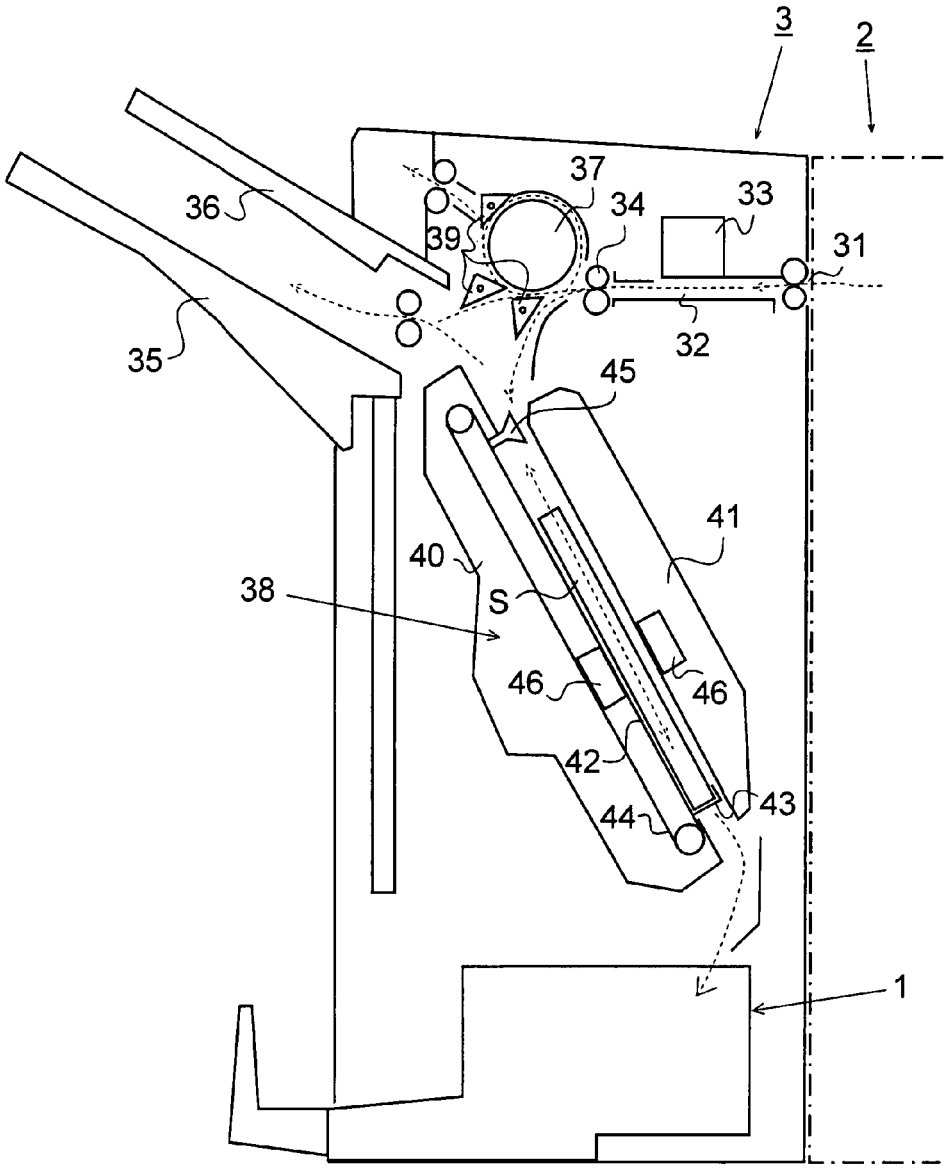
FIG. 1 is a schematic sectional view illustrating the outline of a paper post-processing device of the present invention.

First, referring to FIG. 1, a description will be given concerning the paper post-processing device 3 which has the sheet folding device 1 according to the embodiment of the invention built therein. FIG. 1 is a schematic sectional view illustrating the outline of the paper post-processing device 3 according to the embodiment of the invention.

The paper post-processing device 3 carries a discharged sheet S on which an image is formed by the image forming apparatus 2 into the paper post-processing device 3 through a sheet feed port 31 provided at the upper right side of the paper post-processing device 3. Then the paper post-processing device 3 performs predetermined post-processing, such as stapling processing, on this sheet S carried in. Near the most upstream portion of a sheet conveyance path 32, a punching part 33 is provided. Downstream of the punching part 33 in the sheet conveyance direction, a pair of intermediate rollers 34 are provided. Also provided are: an escape roller 37 for temporarily permitting a sheet S conveyed from the pair of intermediate rollers 34 to escape; a staple processing device 38 provided at the middle of the device for stacking sheets S fed to the paper post-processing device 3 and then performing staple processing on them; the sheet folding device 1 provided below the staple processing device 38; and so on. Further, on the left side surface of the paper post-processing device 3, a main discharge tray 35 for receiving discharged a sheet S (a bundle of sheets S) is provided. Above the main discharge tray 35, a sub discharge tray 36 is provided.

The punching part 33 performs punching processing on a sheet S at predetermined timing in accordance with the setting made by the user. The pair of intermediate rollers 34 is intended to convey a sheet S toward the escape roller 37, the main discharge tray 35, the sub discharge tray 36, the staple processing device 38, or the like.

The main discharge tray 35 is mainly intended to receive a bundle of sheets S discharged after being stapled by the staple processing device 38. The main discharge tray 35, as the number of bundles of sheets S discharged increases, is sequentially moved downward from the highest position so as to be able to receive a plurality of bundles of sheets S. Then when the bundles of sheets S are removed from the main discharge tray 35, the main discharge tray 35 moves up, returning to its basic position. The main discharge tray 35 can also be configured to receive a sheet S discharged without being subjected to any processing in the paper post-processing device 3 and a sheet S subjected to the punching processing only.

The sub discharge tray 36, on the other hand, is intended to receive a sheet S discharged without being subjected to any processing in the paper post-processing device 3 and a sheet S subjected to the punching processing only. The escape roller 37, in a case where a plurality of bundles of sheets S are successively subjected to the stapling processing, wrap a first page of the immediate next bundle of sheets S around the drum surface, thereby putting this sheet S on standby while the former bundle of sheets S is being stapled by the staple processing device 38. The function of the escape roller 37 eliminates the need for temporarily stopping the discharge of a sheet S from the image forming apparatus 2 during the stapling processing, thus improving the processing efficiency.

Sorting sheets S that have passed through the punching part 33 to the staple processing device 38, the escape roller 37, the main discharge tray 35, the sub discharge tray 36, and the like, respectively, is achieved by a plurality of guides 39 so provided as to be pivotably held in the paper post-processing device 3.

The staple processing device 38 can perform stack processing for stacking a plurality of sheets S and various stapling processing, such as leading end binding for binding the leading ends of a bundle of staked sheets S with a stapler, center binding for binding a bundle of sheets S at two places along the lateral direction from the longitudinal center of the bundle of sheets S, and the like. For example, the leading end binding includes: leading end center binding for binding a bundle of sheet S at two places along the longitudinal direction near the center of the leading end thereof; leading end diagonal binding for binding at one place at one corner of the leading end of a bundle of sheets S diagonally at 45°; and the like. A bundle of sheets S subjected to the stack processing or the leading end binding are conveyed upward and then discharged from the paper post-processing device 3.

The staple processing device 38 is mainly composed of two members, a stack tray 40 provided at a lower position in FIG. 1 and a cover tray 41 provided at an upper position therein. In the stack tray 40, a sheet loading surface 42 is so provided as to be sandwiched between the stack tray 40 and the cover tray 41. Onto this sheet loading surface 42, a plurality of sheets S are stacked as a bundle. For the purpose of receiving a sheet S conveyed toward the sheet loading surface 42, the stack tray 40 is provided with a stopper 43.

This stopper 43 is arranged at a substantially widthwise (perpendicular to the plane of the FIG. 1) center of the stack tray 40, is so provided as to face the front and rear surfaces of the stack tray 40, and fitted to a stretched endless belt 44. The stopper 43, in accordance with the size of a sheet S used, stands by so that the rear end of the sheet S (top end of the sheet S in FIG. 1) is stacked at a fixed position. The endless belt 44 is controlled by a driving mechanism (not shown) to rotate reversibly. As a result, in accordance with contents of processing, the stopper 43 is moved downward from the top of the stack tray 40 and then upward from the bottom thereof while a bundle of sheets S stacked are conveyed toward the main discharge tray 35 or toward the sheet folding device 1.

In the stack tray 40, a second endless belt (not shown) is arranged in parallel to the endless belt 44 in such a manner as to face the front and rear surfaces of the stack tray 40. This second endless belt is provided with a projection 45 formed into a substantially T-shape. The projection 45 moves downward from its basic position as a result of rotation of the second endless belt by a predetermined degree by the driving mechanism (not shown), slightly presses the rear ends of sheets S stacked to perform alignment processing for aligning the rear ends of the plurality of sheets S. This prevents misalignment of the rear ends of the plurality of sheets S stacked. This operation is performed each time when one sheet S is stacked, thereby permitting appropriate stapling processing.

The cover tray 41 plays a role in guiding a bundle of sheets S stacked so that it can be reliably conveyed toward the main discharge tray 35 or the sheet folding device 1.

With the mechanism as described above, upon completion of stacking processing of a predetermined number of sheets S, a stapler 46 provided in the staple processing device 38 performs stapling processing on a bundle of sheets S stacked.

Below the staple processing device 38, the sheet folding device 1 is arranged to perform folding processing on a bundle of sheets S. The details of the sheet folding device 1 will be described later. When folding processing is not selected, a bundle of sheets S subjected to the stapling processing is conveyed upward and discharged onto the main discharge tray 35.

Figure 2:
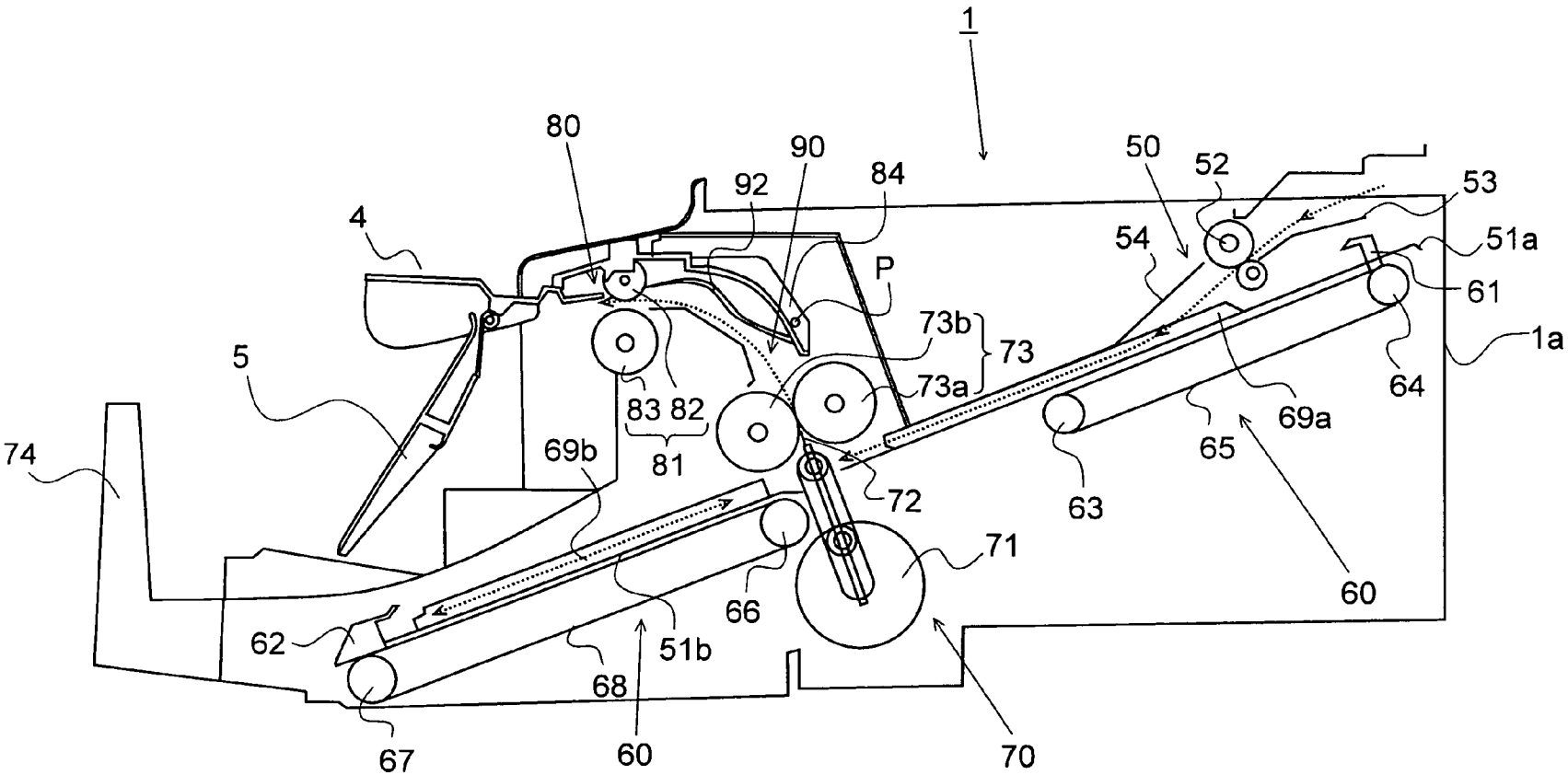
FIG. 2 is a schematic diagram for explaining structure of a sheet folding device of the invention.

Next, referring to FIG. 2, the outline of the structure of the sheet folding device 1 according to the embodiment of the invention will be described. FIG. 2 is a schematic sectional view illustrating the structure of the sheet folding device 1 according to the embodiment of the invention.

The sheet folding device 1 according to this embodiment is disposed at the lowermost part of the paper post-processing device 3 and provided downstream of the staple processing device 38 in the sheet conveyance direction. Mainly, a bundle of sheets S subjected to center binding stapling processing is carried into this device. Therefore, the sheet folding device 1 according to this embodiment mainly functions to fold a bundle of sheets S. When folding processing is selected, the sheet folding device 1 performs folding processing, such as middle folding processing, on the bundle of sheets S, and then discharges them onto a discharge tray 74 provided at the bottom of one side surface of the paper post-processing device 3.

As shown in FIG. 2, the sheet folding device 1 includes: a sheet carry-in path 50 for carrying a sheet S (hereinafter, sheet S includes a bundle of sheets S in the description of the sheet folding device 1 of this embodiment) into a casing 1*a*; sheet loading plates 51*a* and 51*b* for loading a sheet S carried in; an aligning part 60 for aligning a sheet S carried in; a folding part 70 for folding a sheet S; a discharge part 80 for discharging a sheet S already subjected to the folding processing; and a discharge and conveyance path 90 for conveying a sheet S from the folding part 70 toward the discharge part 80. Directions of carrying-in, conveying, and discharging a sheet S are dedicated by arrows of a broken line.

The sheet carry-in path 50 is provided at an upper right part of the sheet folding device 1 in FIG. 2. The sheet carry-in path 50 is mainly composed of a pair of carry-in rollers 52 and carry-in guides 53 and 54. By these pair of carry-in rollers 52 and carry-in guides 53 and 54, a sheet S that has passed through the staple processing device 38 is carried into the sheet folding device 1. More specifically, the sheet S is conveyed toward the sheet loading plates 51*a* and 51*b* (to be described later).

The pair of carry-in rollers 52 may be provided with a rotational driving force by a motor or the like (not shown). If a pair of conveyance rollers (not shown) rotationally driven are provided at the lower end of the staple processing device 38 (see FIG. 1) located on the upstream side, the rotational driving force may not be provided. The carry-in guides 53 and 54 may be provided additionally, and the carry-in guides 53 and 54 guide a sheet S so that the sheet S appropriately enters into the pair of carry-in rollers 52 and are appropriately conveyed toward the sheet loading plates 51*a* and 51*b*.

The sheet loading plates 51*a* and 51*b*, two in total, are, as shown in FIG. 2, so provided as to extend from the upper right to the lower left inside the sheet folding device 1, with a crank mechanism 71 (to be described later) therebetween. That is, in the sheet conveyance direction, the sheet loading plate 51*a* is provided upstream of the crank mechanism 71 and the sheet loading plate 51*b* is provided downstream thereof. The two sheet loading plates 51*a* and 51*b* are each formed of a plate-like member and are provided so that the upstream and downstream sides of the crank mechanism 71 form a straight line in the sheet conveyance direction. Moreover, the sheet loading plates 51*a* and 51*b* have some widths in the sheet S width direction (direction perpendicular to the plane of FIG. 2), and are so provided as to diagonally partition the inside of the sheet folding device 1, as viewed from side. Then, onto these sheet loading plates 51*a* and 51*b*, a sheet S carried in is consequently loaded.

The aligning part 60 is provided to align the position of a sheet S carried in on the sheet loading plates 51*a* and 51*b* so that the sheet S can be appropriately bent. The aligning part 60 aligns a sheet S in the direction parallel (horizontal direction in FIG. 2) and perpendicular (direction perpendicular to the plane of FIG. 2) to the sheet S conveyance direction.

As shown in FIG. 2, to align the leading and rear ends (horizontal direction in FIG. 2) of sheets S in the sheet S carry-in direction, a push-out member 61 and a receiving member 62 are provided on the upstream and downstream sides, respectively, in the sheet conveyance direction.

The push-out member 61 is formed into a substantially L-shape in cross section. Then an endless belt 65 is stretched around a driving pulley 63 and a driven pulley 64 disposed below the sheet loading plate 51*a* located upstream of the crank mechanism 71, and the push-out member 61 is fitted to the endless belt 65. The push-out member 61 projects from the surface of the sheet loading plate 51*a* at a substantially central position of the sheet loading plate 51*a* in the width direction (direction perpendicular to the plane of FIG. 2).

The driving pulley 63 is provided as a substantially center of the sheet loading plate 51*a* in the sheet conveyance direction, and the driven pulley 64 is provided near the upstream end of the sheet loading plate 51*a*. The driving pulley 63 receives a rotational driving force transmitted from a motor (not shown) by a driving mechanism (not shown), and capable of rotating reversibly. When the driving pulley 63 is driven into rotation, the driven pulley 64 reversibly rotatably supported and the endless belt 65 also move following this rotation, and the push-out member 61 moves in the direction parallel to the sheet conveyance direction while protruding upward from the sheet loading plate 51*a*.

The receiving member 62 is also formed into a substantially L-shape in cross section. Then an endless belt 68 is stretched around a driving pulley 66 and a driven pulley 67 disposed below the sheet loading plate 51*b* located downstream of the crank mechanism 71, and the receiving member 62 is fitted to the endless belt 68. The receiving member 62 projects from the surface of the sheet loading plate 51*b* at a substantially central position of the sheet loading plate 51*b* in the width direction (direction perpendicular to the plane of FIG. 2).

The driving pulley 66 is provided near the upstream end of the sheet loading plate 51*b* and the driven pulley 67 is provided near the downstream end of the sheet loading plate 51*b*. The driving pulley 66 receives a rotational driving force transmitted from the motor (not shown) by the driving mechanism (not shown). When the reversibly rotatable driving pulley 66 is driven into rotation, the driven pulley 67 reversibly rotatably supported and the endless belt 68 also move following this rotation, whereby the receiving member 62 moves across the entire length of the sheet loading plate 51*b* in the direction parallel to the sheet conveyance direction while protruding upward from the sheet loading plate 51*b*.

Moving these push-out member 61 and receiving member 62 in accordance with the size of a sheet S aligns the position of the sheet S carried in in the direction parallel to the sheet conveyance direction (along the length of the sheet S).

As a member for aligning a sheet S in the direction perpendicular to the sheet S conveyance direction (direction perpendicular to the plane of FIG. 2), that is, the sheet S width direction, width adjusting members 69*a* and 69*b*, each in pairs, are provided on the sheet loading plates 51*a* and 51*b*, respectively, in the direction parallel to the sheet conveyance direction, with the crank mechanism 71 therebetween in a manner such that each of the width adjusting members 69*a* and 69 in pairs are spaced apart in the width direction from each other. FIG. 2 shows only one of pairs of the width adjusting members 69*a* and 69*b*. Sheet width adjustment and skew correction are performed by these pairs of the width adjusting members 69*a* and 69*b*. The pair of width adjustment member 69*a* provided on the sheet loading plate 51*a* upstream of the crank mechanism 71 has a rack-and-pinion mechanism (not shown), which is coupled to and driven by a reversibly rotatable motor (not shown).

Alignment, such as width adjustment and skew correction of a sheet S carried in, is achieved by moving the width adjustment member 69*a* by the rack-and-pinion mechanism and the motor in accordance with the size of a sheet S carried in. A rack-and-pinion mechanism and a motor may also be provided in the width adjustment member 69*b* located downstream of the crank mechanism 71 in the sheet conveyance direction, but alignment processing can be performed just by providing them only in one of the width adjusting members 69*a* and 69*b*.

The folding part 70 is composed of the crank mechanism 71, a blade 72, a pair of folding rollers 73, and so on. As shown in FIG. 2, the crank mechanism 71 is disposed at the center bottom of the sheet folding device 1 in such a manner as to be located at a substantially center of the sheet carry-in path 50 in the conveyance direction. The crank mechanism 71 receives a driving force transmitted from a motor (not shown) via a power transmission mechanism (not shown) and is thereby driven into rotation. The crank mechanism 71 is also fitted with the blade 72 pressed into contact with a sheet S.

Above the crank mechanism 71 and the blade 72, the pair of folding rollers 73 are disposed. A folding roller 73*a*, one of the pair of folding rollers 73, receives a driving force from a driving source such as a motor or the like (not shown) via a power transmission mechanism (not shown) and is thereby driven into rotation. A folding roller 73*b*, the other one of the pair of folding rollers 73, is pressed into contact with the folding roller 73*a* and is driven into rotation by the folding roller 73*a*.

Detailed operation of folding a sheet S will be described below. First, the crank mechanism 71 brings the blade 72 into a standby state at position below the sheet loading plates 51*a* and 51*b*. Then, after being carried into the sheet folding device 1, a sheet S is loaded onto the sheet loading plates 51*a* and 51*b*, its positions in the width direction and the conveyance direction are further aligned at the aligning part 60. Then the crank mechanism 71 rotates, so that the blade 72 projects to an area above the sheet loading plates 51*a* and 51*b*, thereby pushing out the sheet S vertically upward. Due to a nip portion of the pair of folding rollers 73 present at the protruding tip of the blade 72, the sheet S enters from its folding portion to the nip of the pair of folding rollers 73 while being bent. Then the crank mechanism 71 continues its rotation, thereby returning the blade 72 to its original standby position. Hereinafter, folding processing can be performed successively in the same manner.

Figure 3:
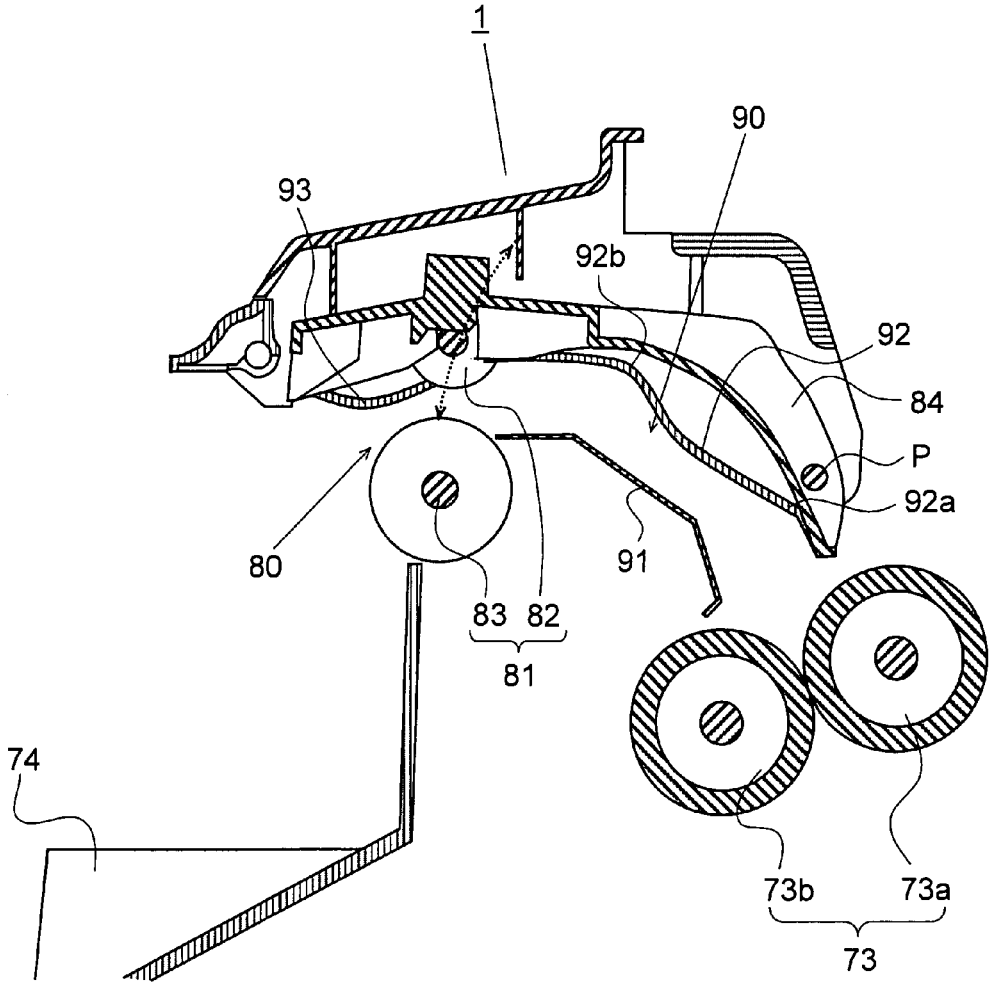
FIG. 3 is a partially enlarged view of the surrounding of a discharge part in FIG. 2.

The discharge part 80 and the discharge and conveyance path 90 are provided for discharging a bent sheet S from the inside of the sheet folding device 1. FIG. 3 is a partially enlarged view of the surrounding of the discharge part and the discharge and conveyance path in FIG. 2. The construction and operation of the discharge part and the discharge and conveyance path will be described, referring to FIG. 3.

First, the discharge part 80 will be described. The discharge part 80 is a portion where a sheet S already subjected to the folding processing is discharged from the sheet folding device 1, and is mainly composed of a pair of discharge rollers 81. The pair of discharge rollers 81 are so provided as to be located adjacently above one end of the discharge tray 74. The pair of discharge rollers 81 are composed of two discharge rollers 82 and 83 rotatably supported so as to extend vertically in a line. The upper discharge roller 82 is movable upward and downward (the direction of movement is indicated by an arrow of a broken line in FIG. 3). Depending on the thickness or stiffness of a sheet S entering to the pair of discharge rollers 81 after subjected to the folding processing, the upper discharge roller 82 moves. Such construction permits supporting different thicknesses for different folding processing, thereby preventing jam and bending. The pair of discharge rollers 81 also function to additionally fold a sheet S bent by the pair of folding rollers 73 so as to prevent the folding portion from swelling. An appropriate interval between the pair of discharge rollers 81 according to this embodiment is ensured for each sheet S discharged, thus permitting preventing such swelling, jam, and bending.

The mechanism of movement of the upper discharge roller 82 will be described. In the sheet folding device 1 of this embodiment, a pivoting member 84 is provided. As shown in FIG.3, the pivoting member 84 is located above the discharge and conveyance path 90 (to be described in detail later), and is so provided as to extend from above the folding roller 73*a* to the vicinity of the upper discharge roller 82 by drawing a gentle curve. That is, the pivoting member 84 forms the discharge part 80 and the discharge and conveyance path 90. The pivoting member 84 has a support point P above the folding roller 73*a* and is pivotable with this support point P through a predetermined angle. The pivoting member 84 pivotably supports the upper discharge roller 82. With such construction, the upper discharge roller 82 moves in accordance with the thickness and also restoring force of a bent sheet S entering the pair of discharge rollers 81. The pivoting member 84 is provided with an upper guide 92 (to be described in detail later) for guiding conveyance of a sheet S.

Next, the discharge and conveyance path 90 will be described. As shown in FIG. 3, the discharge and conveyance path 90 is provided for conveying a bent sheet S from the pair of folding rollers 73 to the pair of discharge rollers 81. The discharge and conveyance path 90 is formed of tow guides, lower guide 91 and upper guide 92. The lower guide 91 is provided to extend in the direction perpendicular to the plane of FIG. 3 so as to link together the folding roller 73*b* and the lower discharge roller 83. The upper guide 92 is provided to extend so as to link together the folding roller 73*a* and the upper discharge roller 82. The lower guide 91 and the upper guide 92 guide a bent sheet S toward the pair of discharge rollers 81 by abutting the bent sheet S.

As shown in FIG. 3, a cross section of the upper guide 92 in the sheet conveyance direction is formed as two curves connected together, in other words, inversed-S-shaped in FIG. 3. That is, the upper guide 92 is so formed as to locally swell downward in the sheet discharge direction between the folding part 70 and the discharge part 80. More specifically, the discharge and conveyance path 90 is curved, with the upper guide 92 so formed as to swell upward in the sheet discharge direction at an inlet portion 92*a* and outlet portion of 92*b* of the discharge and conveyance path 90 and with the upper guide 92 so formed as to swell downward between the inlet portion 92*a* and outlet portion 92*b* of the discharge and conveyance path 90. Moreover, as shown in FIG. 3, the upper guide 92 is provided below the pivoting member 84 described above.

Forming the upper guide 92 in this manner achieves ideal conveyance of a bent sheet S. That is, an introductory portion to the discharge and conveyance path 90 is wide so that a sheet S bent by the pair of folding rollers 73 can easily enter into the discharge and conveyance path 90. Therefore, the sheet S can be easily introduced to the discharge and conveyance path 90, thus causing no bending and jam of the sheet S.

As a sheet S moves ahead on the discharge and conveyance path 90, the vertical width of the discharge and conveyance path 90 becomes narrower. This therefore permits reducing the degree of swelling of the bent sheet S in the discharge and conveyance path 90, thereby preventing the folding portion of the sheet S from being directed downward when discharged from the pair of discharge rollers 81. In this manner, a sheet S is discharged more upward than the one conventionally discharged, and a sheet S currently discharged can climb a slope formed by a sheet S already discharged.

Further, as shown in FIG. 3, to orient a bent sheet S upward upon its discharge, the sheet folding device 1 of this embodiment has a downstream guide 93 provided downstream of the upper discharge roller 82 in the sheet discharge direction. The downstream guide 93 is provided in the pivoting member 84 and so formed as to swell downward in the sheet discharge direction.

As described above, since the downstream guide 93 is provided downstream of the upper discharge roller 82, the top of a bent sheet S discharged can be pulled, whereby its folding portion can be flattened. Further, due to the presence of the downstream guide 93, the top of the sheet S discharged is pressed, whereby the discharged sheet S is guided with the folding portion oriented downward.

As another component included in the sheet folding device 1, there is the discharge tray 74, which receives a sheet S discharged from the sheet folding device 1 and which is provided adjacently to the discharge part 80. In the discharge tray 74, at the downstream end in the sheet discharge direction, a wall part 74*a* (see FIG. 5) is provided vertically so as to permit reception of a sheet S.

Figure 4:
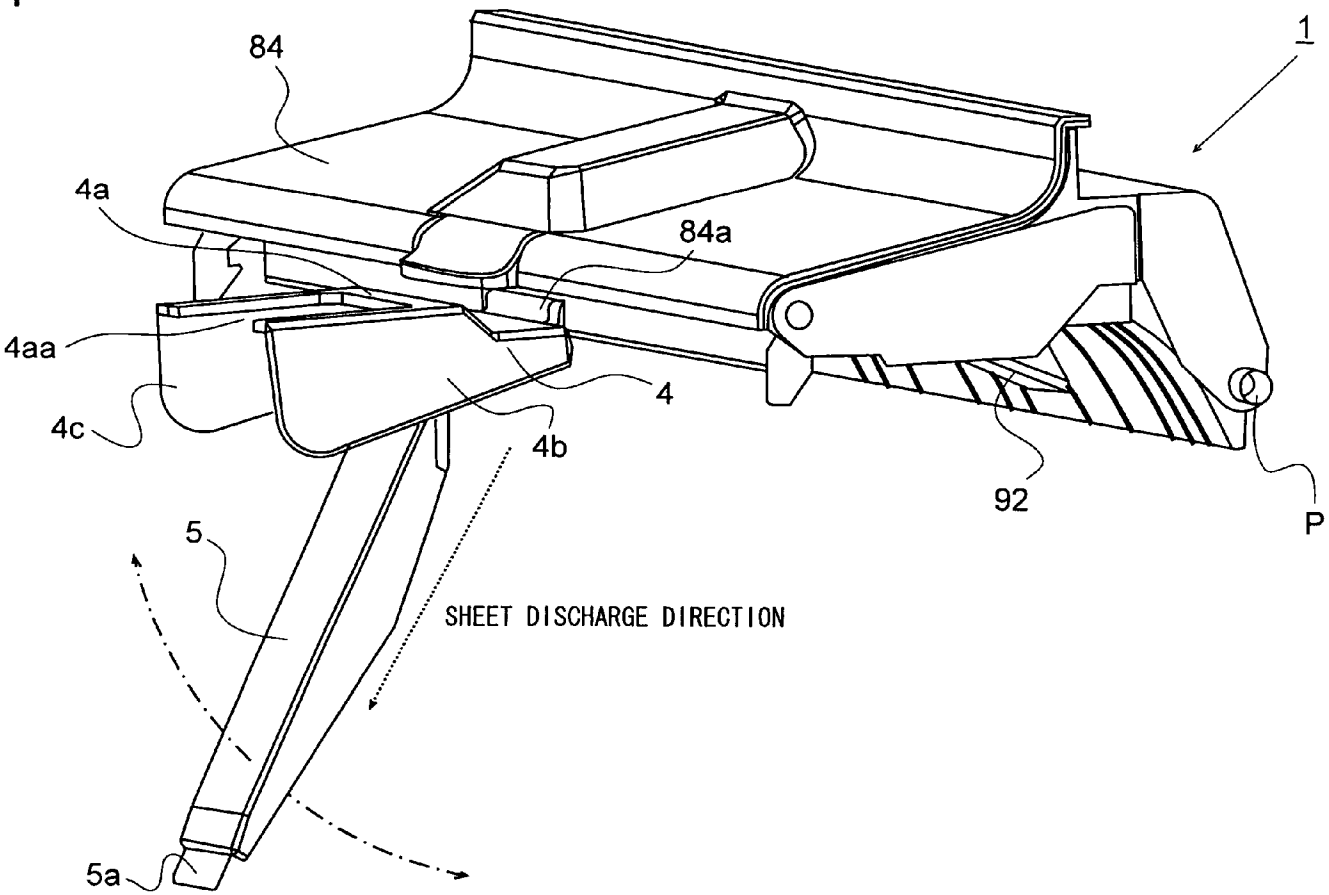
FIG. 4 is a perspective view illustrating an arm and a holding member in the sheet folding device of the invention.
Figure 5:
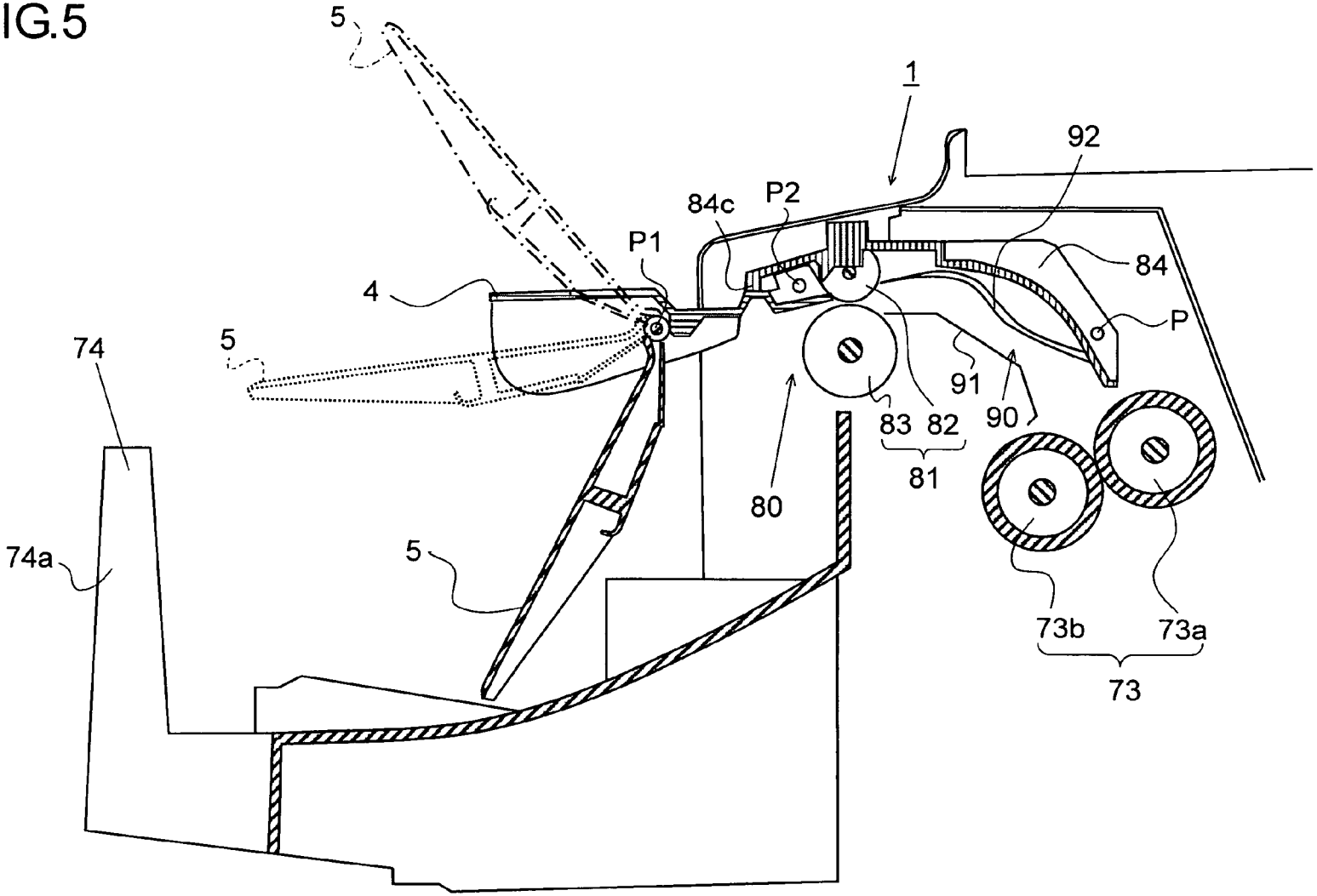
FIG. 5 is a sectional view illustrating the arm and the holding member in the sheet folding device of the invention.

Next, referring to FIGS. 4 and 5, the structure of the arm 4 and the holding member 5 in the sheet folding device 1 according to the embodiment of the invention will be described. FIG. 4 is a perspective view illustrating the arm 4 and the holding member 5 in the sheet folding device 1 according to the embodiment of the invention. FIG. 5 is a sectional view illustrating the arm 4 and the holding member 5 in the sheet folding device 1 according to the embodiment of the invention.

Figure 9A:
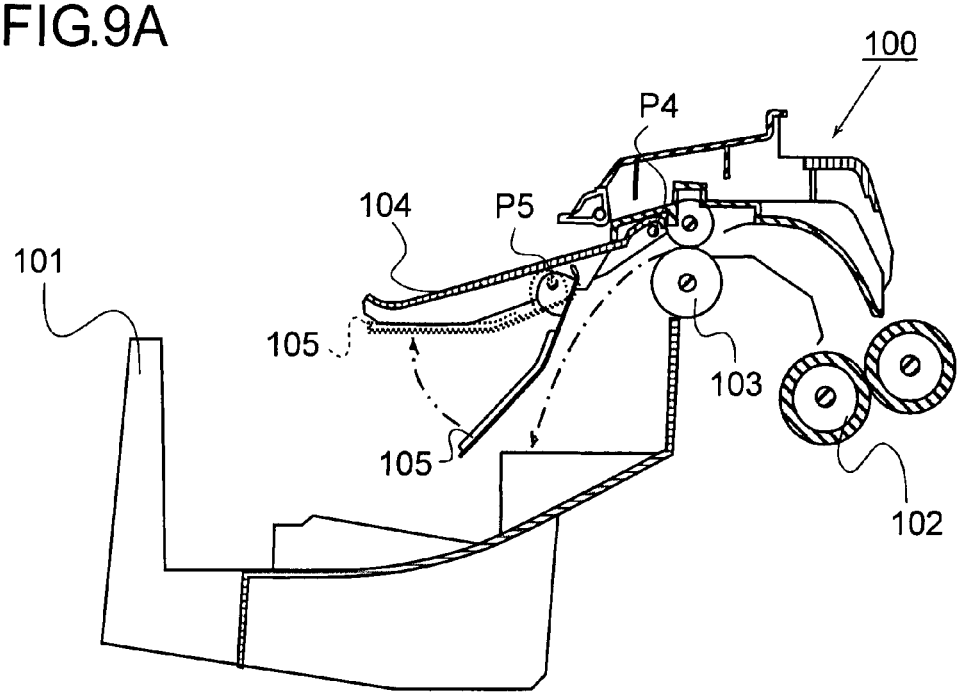
FIG. 9A is a sectional view illustrating a sheet discharge direction on a discharge tray in a conventional sheet folding device.
Figure 9B:
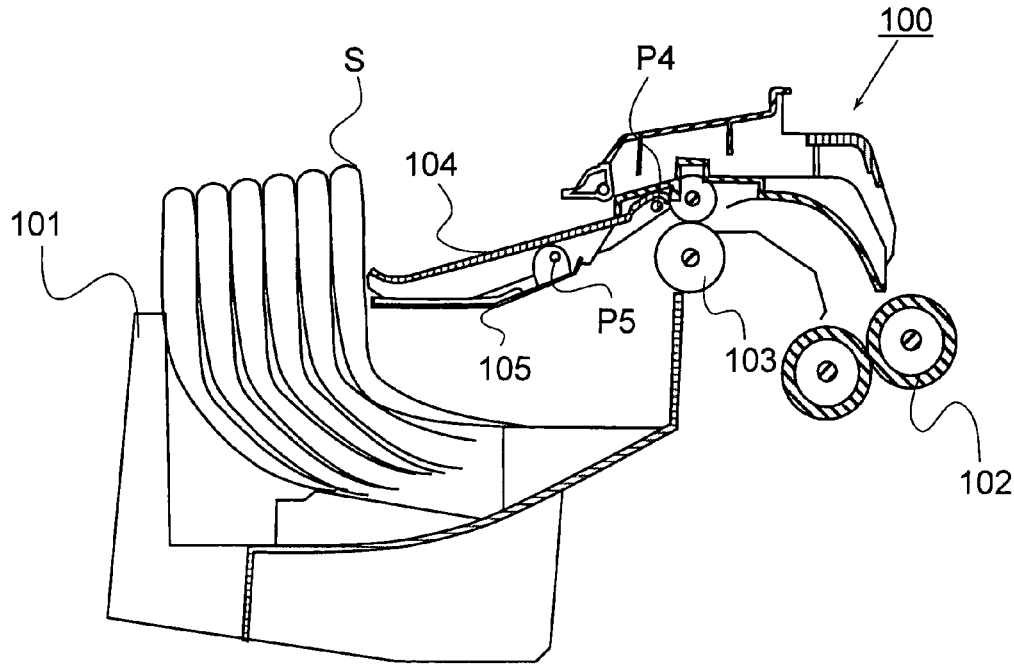
FIG. 9B is a sectional view illustrating a state of sheets stacked on the discharge tray in the conventional sheet folding device.

As shown in FIG. 4, the arm 4 is supported at a one side part 84*a* located on the downstream side of the pivoting member 84 in the sheet discharge direction. More specifically, as shown in FIG. 5, the arm 4 is disposed above the discharge tray 74 and also adjacently to the discharge part 80 in such a manner as to project in the sheet discharge direction. The arm 4 is so arranged as to be located at the substantially widthwise center of a discharged sheet S. In addition, a top surface 4*a* of the arm 4 has a concave shape, in a plan view, formed with a notch 4*aa* opening on the downstream side in the sheet discharge direction (the sheet discharge direction is indicated by a broken line in FIG. 4). From the both side ends of the top surface 4*a*, two side plates 4*b* and 4*c* are formed vertically downward. The arm 4 can be supported in such a manner as to be pivotable upward and downward or to be fixed (see FIG. 9). This point will be described later.

Then, as shown in FIG. 5, the holding member 5 for holding a discharged sheet S from the above is so supported as to be rotatable upward and downward by the support point P1 provided on the bottom surface of the arm 4 (the rotation direction is indicated by a dashed line). The holding member 5 is formed long along the sheet discharge direction, and formed shorter in the direction perpendicular to the sheet discharge direction than the notch 4*aa* of the arm 4. Such configuration permits the holding member 5 to rotate to a position above the top surface 4*a* of the arm 4 after passing through the notch 4*aa*. The holding member 5 has at the leading end thereof a thin plate-like leading end part 5*a*, which mainly makes contact with a sheet S to reduce the degree of swelling of the sheet S discharged.

Next, referring to FIG. 5, how the holding member 5 rotates will be described. When no sheet S is discharged on the discharge tray 74, the holding member 5 takes such a posture as to hang (indicated by solid lines in FIG. 5). That is, the holding member 5 rotates downward due to its own weight. This prevents a sheet S from being forcefully discharged from the pair of discharge rollers 81 and thereby flying out of the discharge tray 74. Moreover, the holding member 5 functions to press, from above, swelling of a folding portion of a sheet S discharged onto the discharge tray 74 due to its stiffness, thereby increasing the amount of sheets S to be stacked onto the discharge tray 74.

Then, as sheets S are stacked onto the discharge tray 74, the holding member 5 rotates to the position indicated by a broken line. When sheets S are further stacked, the holding member 5 rotates to the position above the top surface 4*a* of the arm 4 as shown by a dashed line. Conventionally, the holding member 5 is configured to be unable to rotate to the position above the arm 4. In the invention, the holding member 5 rotates to the position above the arm 4. Therefore, the function of pressing the top surface of a sheet S to orient the discharge direction downward by the holding member 5 does not work at the time when the holding member 5 rotates to the position above the bottom end of the arm 4, and thus a phenomenon that a sheet S being discharged pushes out a sheet S previously discharged disappears during the course of stacking of sheets S.

Conventionally, after sheets S are stacked and then the holding member 5 rotates up to the upper limit, the sheets S are stuck between the discharge tray 74 and the holding member holding member 5, and thus a force of pressing sheets S by the holding member 5 becomes stronger every time a sheet S is stacked, thereby hindering the discharge of sheets S, which no longer occurs. That is, a sheet S can be more easily discharged, resulting in a larger stack volume than is achieved conventionally.

As is obvious from FIGS. 4 and 5, the holding member 5 is longer than the arm 4 in the sheet discharge direction. Stacking a large number of sheets S eventually causes the sheet S to make contact with the arm 4, thereby impeding the discharge of sheets S (see FIG. 5). Conventionally, the arm 4 is formed longer than the holding member 5 (see FIG. 7), and thus the stack volume up to a point when a sheet S makes contact with the arm 4 is small. However, in this embodiment, the length of the arm 4 in the sheet discharge direction is adapted to be equal to or less than half the maximum length in the conveyance direction of a sheet S discharged onto the discharge tray 74 after subjected to the folding processing (see FIG. 6). This permits increasing the stack volume without the arm impeding the stacking and discharge of sheets S. Moreover, since the holding member 5 is longer than the arm 4, the length of the arm 4 can be shortened to a minimum possible length, compared to that of a conventional one while ensuring the effect of pressing sheets S by the holding member 5.

As described above, with the configuration such that the holding member 5 is rotatable to a position above the bottom end of the arm, that is, a position where it completely overlaps the arm 4 as viewed from side, the function of pressing the top surface of a sheet S does not work at the point when the holding member 5 rotates to a position above the bottom end of the arm 4. However, for configuration such that the holding member 5 is longer than the arm 4 and projects from the leading end of the arm 4 toward the downstream side when rotating to a position substantially parallel to the arm 4, if the holding member 5 rotates only up to a position where it overlaps the arm 4 (position indicated by the broken line of FIG. 4), a sheet S becomes stuck between the discharge tray 74 and the leading end of the holding member 5, thus impeding the stacking of the sheet S. Therefore, it is preferable that the holding member 5 be rotatable up to a position above the top surface 4*a* of the arm 4.

Figure 6A:
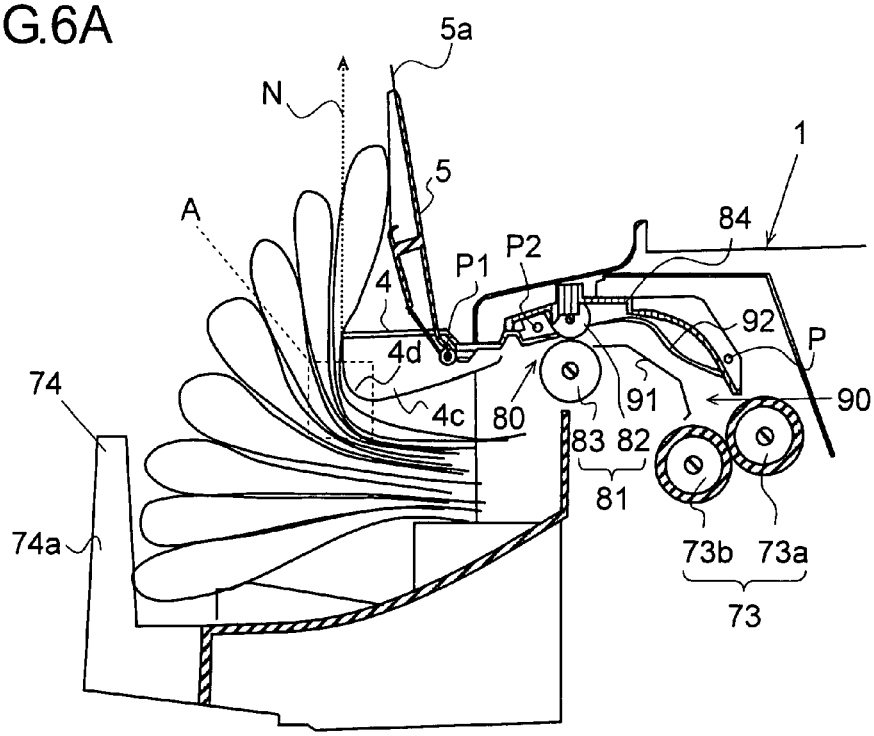
FIG. 6A is a sectional view showing a case where rotation of the holding member to a position above the arm is limited in the sheet folding device of the invention.
Figure 6B:
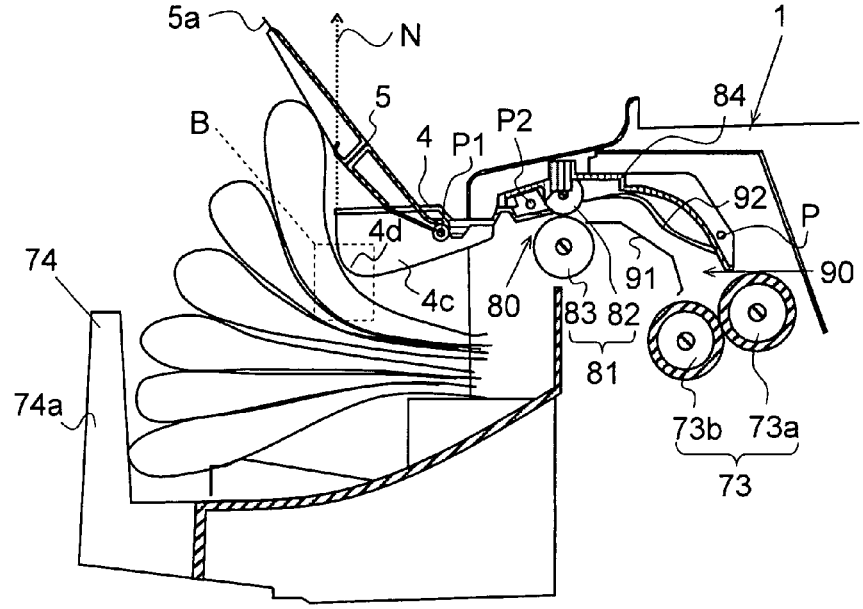
FIG. 6B shows a case where the rotation of the holding member to a position above the arm is not limited in the sheet folding device of the invention.

Next, referring to FIG. 6, the upper limit of the rotation of the holding member 5 in the sheet folding device 1 according to the embodiment of the invention will be described. FIG. 6A is a sectional view showing a case where the rotation of the holding member 5 according to the embodiment of the invention to a position above the arm 4 is not limited. FIG. 6B is a sectional view showing a case where the rotation of the holding member 5 according to the embodiment of the invention to a position above the arm 4 is limited.

As shown in FIG. 6A, in the sheet folding device 1 of this embodiment, as a large number of sheets S are stacked, not the holding member 5 but the arm 4 comes into contact with the sheet S. Thus, at the bottom of the leading ends of the side plates 4*a* and 4*b* of the arm 4, a curved part 4*d* is formed for the purpose of reducing the friction with a sheet S and also guiding the sheet S in such a manner that permits it to easily climb the slope formed by the sheets on the discharge tray 74. However, unless some limitation is put on the rotation of the holding member 5 to a position above the arm 4, the folding portion of a sheet S stacked, that is, the leading end of the sheet S discharged is eventually oriented in the direction opposite to the sheet discharge direction. In other words, the sheet S discharged is stacked with its folding portion falling toward the upstream side of the arm 4.

As a result, a slope formed by the sheets S in a range A enclosed by broken lines in FIG. 6A becomes steep. Moreover, the next sheet S discharged needs to enter a contact area between a sheet S previously discharged and the arm 4. Therefore, a slope on which the next sheet S discharged can never climb is formed, which closes the discharge part 80, thereby resulting in a decrease in the stack volume.

In the sheet folding device 1 according to this embodiment, as shown in FIG. 6B, when rotating to a position above the arm 4, the rotation of the holding member 5 is limited so that the leading end part 5*a* of the holding member 5 is rotatable only up to at maximum a position downstream, in the sheet discharge direction, of a vertical line N passing through the downstream end of the arm 4 in the sheet discharge direction.

Limiting the upward rotation of the holding member 5 constant results in a gentler slope formed by sheets S in a range B surrounded by a broken line in FIG. 6B than that shown in FIG. 6A. Therefore, the sheets S can be easily discharged, thus permitting an increase in the stack volume of sheets S on the discharge tray 74. In this case, the rear surface of the holding member 5 could make contact with the sheet S and thus serve as resistance against the discharge of the sheet S. However, the sheet S and the holding member 5 similarly contact with each other in the mode shown in FIG. 6A; thus, the configuration of FIG. 6B is more preferable.

Therefore, in the sheet folding device 1 in this embodiment, the rotation of the holding member 5 is limited. Used as a method for limiting the rotation of the holding member 5 may be a well-known method, for example, providing a stopper (not shown) for limiting the rotation of the holding member 5 at the support point P1, the arm, or the like, or adjusting the length, in the conveyance direction, of the notch 4*aa* (see FIG. 4) through which the holding member 5 passes.

Figure 7:
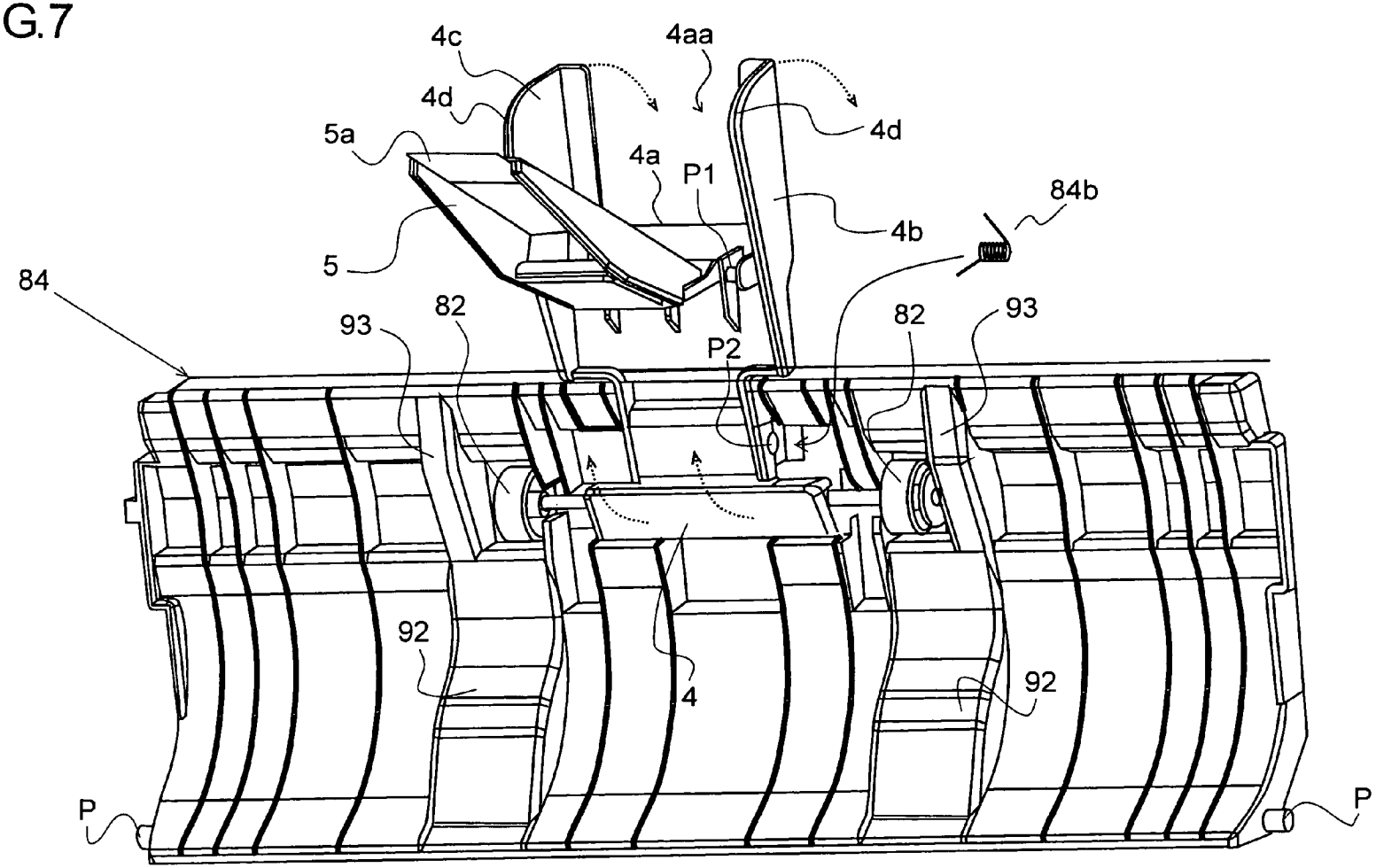
FIG. 7 is a perspective view of a pivoting member for use in the sheet folding device of the invention, as viewed from behind.
Figure 8:
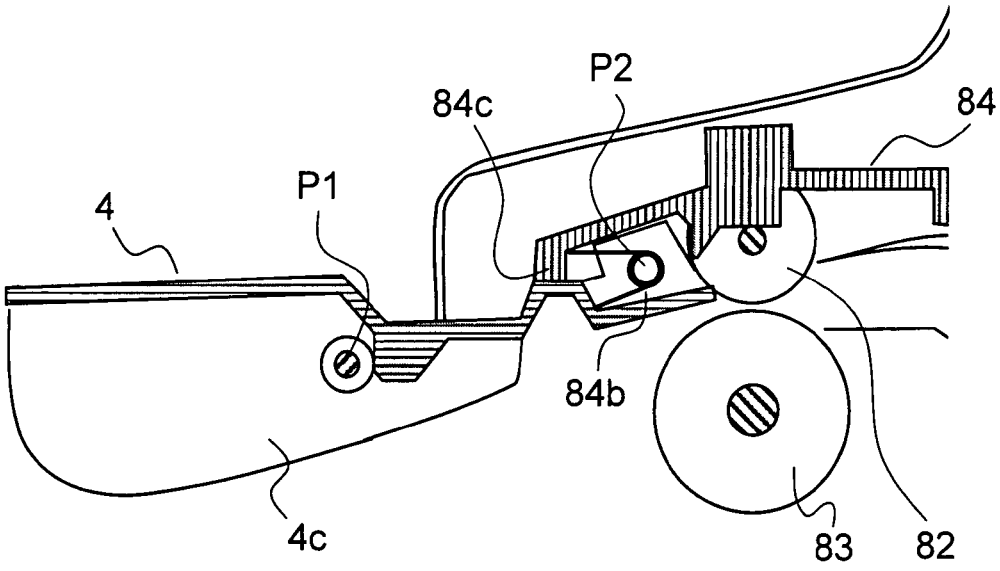
FIG. 8 is a side sectional view showing a relationship between the arm and the pivoting member in the sheet folding device of the invention.
Figure 10:
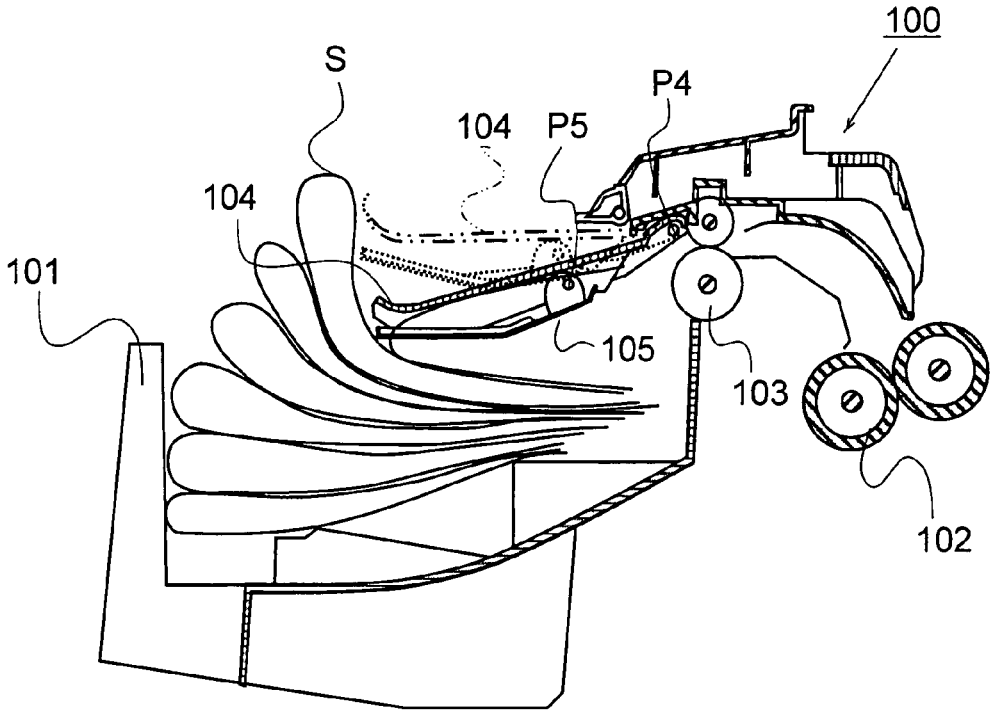
FIG. 10 is a sectional view illustrating arm pivoting in the conventional sheet folding device.

Next, referring to FIGS. 5, 7, 8, and 10, the pivoting of the arm 4 in the sheet folding device 1 according to the embodiment of the invention will be described. FIG. 7 is a perspective view of the pivoting member 84 of the sheet folding device according to the embodiment of the invention as viewed from behind. FIG. 8 is a side sectional view showing a relationship between the pivoting member 84 and the arm 4. FIG. 10 is a sectional view illustrating the pivoting of the arm 4 in a conventional sheet folding device.

First, a description is given on a problem arising from configuration such that the arm pivots upward and downward. In FIG. 10, the upper limit position of an arm 104 under the assumption that the arm is pivotable is indicated by a broken line. A sheet S currently being discharged is indicated by a chain double-dashed line.

If the arm 104 is pivotable upward and downward in the sheet folding device 100, resistance between a holding member 105 and a sheet S can be reduced. Thus, the conventional sheet folding device 100 usually has the arm 104 pivotable. However, the upward pivoting of the arm 4 as shown by the chain double-dashed line in FIG. 10 brings about adverse effect that a sheet S being discharged swells due to restoring force of the bent sheet S. The swelling of the sheet S being discharged disperses a force of discharging the sheet S, thus resulting in a decrease in the stack volume of sheets S on a discharge tray 101.

Accordingly, in the sheet folding device 1 according to this embodiment, the arm 4 is fixed at a position corresponding to an arm 104 indicated by a solid line of FIG. 10 during stacking of a sheet S. More specifically, the arm 4 may be fixed to the pivoting member 84 forming part of the sheet folding device 1 in FIG. 5.

The arm 4 may be so supported as to be pivotable upward and downward. More specifically, as shown in FIG. 5, in supporting the arm 4 by the pivoting member 84 forming part of the sheet folding device 1, with a support point P2 provided at the pivoting member 84, the arm 4 is so supported as to be movable upward and downward. A projection 84*c* provided at the left end of the pivoting member 84 in FIG. 5 is adapted to be constantly in contact with the top surface of the arm 4. Due to this contact between the projection 84*c* and the arm 4, the weight of the pivoting member 84 also needs to be lifted up to pivot the arm 4 upward.

Further, as shown in FIGS. 7 and 8, at a portion where the pivoting axis (support point P2) of the arm 4 lies, a biasing member for biasing the arm 4 downward, that is, a coil spring 84*b* may be formed. With such configuration, the arm 4 does not easily pivot upward. In this embodiment, due to its configuration, the pivoting of the arm 4 is accompanied by upward pivoting of the pivoting member 84.

The arm 4 is pivotable only in the direction indicated by arrows of a broken line shown in FIG. 7 (upward in the sheet folding device 1), and thus cannot pivot downward in the sheet folding device 1 (hereinafter simply referred to as downward). The configuration that limits the downward pivoting of the arm 4 may be achieved by integrally fitting the arm 4 to the rear side of the pivoting member 84 and engaging them with each other, as shown in FIG. 7. This configuration locks the downward movement of the arm 4 in the sheet folding device 1, disabling the downward movement of the arm 4.

Now, the magnitude of a basing force of biasing the arm 4 by the coil spring 84*b* will be described. The magnitude of a biasing force is set at such a value that movement of the arm 4 is not induced by discharge of a sheet S. This is intended to prevent the sheet S being discharged from swelling, as described above. However, when the arm 4 is fixed completely, the arm 4 could hinder the user from removing a sheet S on the discharge tray 74 or handling a jam. Thus, it is preferable that the arm 4 be fixed to the extent that permits the user to move the arm 4. That is, the magnitude of biasing force is desirably set in a range such that the movement of the arm 4 is not induced by the discharge of a sheet S and thus the user can move the arm 4. Since it is difficult to uniquely define the detailed biasing force of the coil spring 84*b*, it may be appropriately defined through overall judgment based on the type and size of a sheet S to be bent, the number of sheets S to be stacked, and so on.

As described above, the sheet folding device 1 provided with the folding part 70 for folding a sheet S carried into the device, the discharge part 80 for discharging a sheet S already subjected to folding processing, the discharge tray 74 for receiving a sheet S discharged from the discharge part 80, the arm 4 arranged above the discharge tray 74 and adjacently to the discharge part 80 and so provided as to project in the sheet discharge direction, and the holding member 5 for holding a sheet S discharged from the above, supported at the arm 4 in such a manner as to be rotatable upward and downward, and capable of rotating to a position above the bottom end of the arm 4 no longer exerts an influence that the holding member 5 directs the sheet S discharge direction downward during the course of stacking a large number of sheets S. Therefore, the phenomenon that a sheet S previously discharged pushes out a sheet S being discharged is suppressed, thus resulting in a gentler slope formed by sheets S stacked than is conventionally formed. That is, this permits a larger volume of stacking on the discharge tray 74 than the conventional one without upsizing the discharge tray 74. Further, adapting the holding member 5 to be rotatable to a position above the arm 4 permits an increase in the stack volume of sheets S even with configuration such that the holding member 5 projects to the side downstream of the leading end of the arm 4 when the holding member 5 rotates to a position substantially parallel to the arm 4.

Providing a longer length of the holding member 5 in the sheet discharge direction than that of the arm 4 permits a larger stack volume of sheets S than is achieved in a case where the arm 4 is formed longer than the holding member 5. That is, the arm 4, when a large number of sheets S are stacked, makes contact with the sheet S, thus impeding discharge of the sheets S, but the stack volume of sheets S can be increased by minimizing the length of the arm 4 compared to the conventional one.

Rotation of the holding member 5 excessively upward results in a steep slope formed by sheets S stacked, which disables a sheet S discharged to climb the slope. In the invention, in a case where the holding member 5 rotates to the highest possible position above the arm 4, its rotation is limited so that the leading end part 5*a* of the holding member 5 is located downstream of the leading end of the arm 4 in the sheet discharge direction. This permits a gentle slope to be formed by sheets S stacked, thus resulting in a larger number of sheets S stacked onto the discharge tray.

Moreover, fixing the arm 4 to the sheet folding device 1 or supporting the arm 4 by the sheet folding device in such a manner as to be tunable only upward and also biasing the arm 4 downward by the biasing member permits the arm 4 not to be oscillated by discharge of sheets S. Consequently, the arm 4 reliably guides the sheets S, whereby the sheets S are reliably stacked. In addition, upward movement of the guide causes a sheet S discharged to swell due to its restoring force, thus making it difficult for the discharged sheet S to climb the slope. However, the sheet folding device 1 of the invention can suppress this swelling, thus making it difficult for sheets S to close the discharge part 80, which permits an increase in the stack volume of sheets S.

Loading of the sheet folding device 1 in the paper post-processing device 3 introducing a sheet S on which an image is formed by the image forming apparatus 2 and then performing predetermined processing can provide a paper post-processing device that provides a larger stack volume of sheets S than a conventional one. Moreover, a post-processing device with advantageous cost performance and simple configuration can be provided while fulfilling original functions possessed by the arm 4 and the holding member 5 without needs for upsizing the discharge tray 74, adding special configuration, or removing the arm 4 or the holding member 5 to increase the stack volume of sheets S.

The embodiment of the invention has been described above, although the range of the invention is not limited thereto. Various modifications can be made within the range not departing the sprits of the invention.

The invention is applicable for use in the sheet folding device and the post-processing device provided with the sheet folding device.

What is claimed is:

1. A sheet folding device comprising:

a folding part for folding a sheet carried into the device;

a discharge part for discharging a sheet subjected to folding processing by the folding part;

a discharge tray for receiving a sheet discharged from the discharge part;

an arm disposed adjacently to the discharge part and projected above the discharge tray in a sheet discharge direction; and a holding member rotatably supported at the arm, the holding member holding a sheet discharged onto the discharge tray from above and also being rotatable to a position above a bottom end of the arm, wherein the arm is supported at the sheet folding device in a manner such as to be pivotable only upward, and is also biased downward by a biasing member, and wherein a pivoting member constituting the discharge part and also pivotable with respect to the sheet folding device is provided, and the arm is fixed to the pivoting member.

2. The sheet folding device according to claim 1, wherein the arm has a specific width vertically with respect to the discharge tray, and the holding member is rotatable up to a position above a top end of the arm.

3. The sheet folding device according to claim 2, wherein a length of the arm in the sheet discharge direction is equal to or less than half a maximum length, in a sheet conveyance direction, of a sheet discharged onto the discharge tray after being subjected to the folding processing.

4. The sheet folding device according to claim 3, wherein the holding member, when rotated to a position where the holding member is parallel to the arm, projects more toward a downstream side in the sheet discharge direction than the arm.

5. The sheet folding device according to claim 2, wherein the rotation of the holding member is limited so that, when the holding member rotates to a maximum above the arm, a leading end part of the holding member is located downstream, in the sheet discharge direction, of a vertical line passing through a downstream end of the arm in the sheet discharge direction.

6. The sheet folding device according to claim 1, wherein the holding member has a thin plate-like leading end part.

7. The sheet folding device according to claim 1, wherein a biasing force of the biasing member is set at least magnitude with which the arm does not pivot upward as a result of discharge of a sheet from the discharge part.

8. The sheet folding device according to claim 1, wherein a curved part is formed at a bottom of a leading end of the arm.

9. A paper post-processing device loading the sheet folding device according to claim 1.

10. An image forming system comprising:

the paper post-processing device according to claim 9; and an image forming apparatus for carrying into the paper post-processing device a sheet on which an image is formed.

11. A sheet folding device comprising:

a folding part for folding a sheet carried into the device;

a discharge part for discharging a sheet subjected to folding processing by the folding part;

a discharge tray for receiving a sheet discharged from the discharge part;

an arm disposed adjacently to the discharge part and projected above the discharge tray in a sheet discharge direction; and a holding member rotatably supported at the arm, the holding member holding a sheet discharged onto the discharge tray from above and also being rotatable to a position above a bottom end of the arm, wherein the arm is supported at the sheet folding device in a manner such as to be pivotable only upward, and is also biased downward by a biasing member, and wherein a pivoting member constituting the discharge part and also pivotable with respect to the sheet folding device is provided, and the arm is pivotably supported at the pivoting member.

12. The sheet folding device according to claim 11, wherein the upward pivoting of the arm is limited by the pivoting member.

13. The sheet folding device according to claim 11, wherein the arm has a specific width vertically with respect to the discharge tray, and the holding member is rotatable up to a position above a top end of the arm.

14. The sheet folding device according to claim 13, wherein a length of the arm in the sheet discharge direction is equal to or less than half a maximum length, in a sheet conveyance direction, of a sheet discharged onto the discharge tray after being subjected to the folding processing.

15. The sheet folding device according to claim 14, wherein the holding member, when rotated to a position where the holding member is parallel to the arm, projects more toward a downstream side in the sheet discharge direction than the arm.

16. The sheet folding device according to claim 13, wherein the rotation of the holding member is limited so that, when the holding member rotates to a maximum above the arm, a leading end part of the holding member is located downstream, in the sheet discharge direction, of a vertical line passing through a downstream end of the arm in the sheet discharge direction.

17. The sheet folding device according to claim 11, wherein the holding member has a thin plate-like leading end part.

18. The sheet folding device according to claim 11, wherein a biasing force of the biasing member is set at least magnitude with which the arm does not pivot upward as a result of discharge of a sheet from the discharge part.

19. The sheet folding device according to claim 11, wherein a curved part is formed at a bottom of a leading end of the arm.

20. A paper post-processing device loading the sheet folding device according to claim 11.

21. An image forming system comprising:

the paper post-processing device according to claim 20; and an image forming apparatus for carrying into the paper post-processing device a sheet on which an image is formed.

* * * * *